US005714019A

United States Patent [19]

Sanders, Jr. et al.

[11] Patent Number: 5,714,019

[45] Date of Patent: Feb. 3, 1998

[54] METHOD OF MAKING ALUMINUM CAN BODY STOCK AND END STOCK FROM ROLL CAST STOCK

[75] Inventors: Robert E. Sanders, Jr., New Kensington; Stephen F. Baumann, Penn Hills, both of Pa.; W. Bryan Steverson, Maryville, Tenn.; Scott L. Palmer, Ravenswood, W. Va.

[73] Assignee: Aluminum Company of America, Pittsburgh, Pa.

[21] Appl. No.: 494,897

[22] Filed: Jun. 26, 1995

[51] Int. Cl.[6] ..... C22F 1/04

[52] U.S. Cl. ..... 148/552; 148/696; 148/439

[58] Field of Search ..... 148/552, 692, 148/696, 439; 420/533, 534, 537, 538, 546, 547, 550, 553

[56] References Cited

U.S. PATENT DOCUMENTS

| | | | |
|---|---|---|---|
| 3,560,269 | 2/1971 | Anderson et al. | 148/11.5 |
| 3,930,895 | 6/1976 | Moser et al. | 148/458 |
| 4,111,721 | 9/1978 | Hitchler et al. | 148/2 |
| 4,186,034 | 1/1980 | Akeret | 148/2 |
| 4,238,248 | 12/1980 | Gyongyos et al. | 148/2 |
| 4,269,632 | 5/1981 | Robertson et al. | 148/2 |
| 4,334,935 | 6/1982 | Morris | 148/2 |
| 4,441,933 | 4/1984 | Boutin et al. | 148/2 |
| 4,517,034 | 5/1985 | Merchant et al. | 148/439 |
| 4,526,625 | 7/1985 | Merchant et al. | 148/2 |
| 4,582,541 | 4/1986 | Dean et al. | 148/551 |
| 4,753,685 | 6/1988 | Usui et al. | 148/439 |
| 4,808,247 | 2/1989 | Komatsubara et al. | 148/2 |
| 4,855,107 | 8/1989 | Teirlinck et al. | 420/546 |
| 4,872,921 | 10/1989 | Teirlinck | 148/2 |
| 4,968,356 | 11/1990 | Tanaka et al. | 148/11.5 A |
| 5,104,459 | 4/1992 | Chen et al. | 148/11.5 A |
| 5,104,465 | 4/1992 | McAuliffe et al. | 148/439 |
| 5,106,429 | 4/1992 | McAuliffe et al. | 148/2 |
| 5,192,378 | 3/1993 | Doherty et al. | 148/691 |
| 5,240,522 | 8/1993 | Tanaka et al. | 148/693 |
| 5,618,358 | 4/1997 | Davisson et al. | 148/552 |

FOREIGN PATENT DOCUMENTS 0061256 9/1982 European Pat. Off. .

OTHER PUBLICATIONS

Teirlinck et al., "Effect of Homogenization on the Behavior of Roll Cast 3004 for Can Stock", Continuous Casting of Non-Ferrous Metals and Alloys; pp. 243–258 (1989).

*Primary Examiner*—George Wyszomierski
*Attorney, Agent, or Firm*—Arnold B. Silverman; David W. Brownlee; E. L. Levine

[57] ABSTRACT

The present invention relates to an improved method of producing aluminum alloy can body stock and can end stock which are particularly suitable for use in manufacturing aluminum alloy can bodies and ends for can bodies. The method for can body stock includes roll casting an aluminum alloy strip having a thickness of less than about 1 to 5 mm and, subsequently, batch annealing the strip, followed by cold rolling, continuous annealing, quenching and cold rolling to desired gauge. The aluminum alloy sheets may then be employed in manufacturing aluminum alloy can bodies. The process produces aluminum alloy sheet having an improved combination strength and caring properties with acceptable surface characteristics. Unique aluminum alloys usable in the claimed processes are also disclosed. In another embodiment, can ends are made by roll casting, followed by cold rolling preferably without prior thermal treatment, continuous annealing, quenching and cold rolling to the desired gauge.

37 Claims, No Drawings

METHOD OF MAKING ALUMINUM CAN BODY STOCK AND END STOCK FROM ROLL CAST STOCK

BACKGROUND OF THE INVENTION

1. Field of the Invention

This invention relates to an improved method of producing casting aluminum alloy sheet and, more specifically, relates to such a method which produces can body and end stock having improved strength, earing properties and surface characteristics and the associated alloys.

2. Description of the Prior Art

In making aluminum alloy can body stock and end stock, it has been known to begin with an AA3004 or 5182 alloy ingot slab which is about 12 inches to 24 inches thick and to progressively reduce the thickness to the desired final gauge by hot and cold rolling with interposed thermal and surface treatments to establish the desired properties. A typical prior art process for producing can body stock might involve the use of a 3004 alloy which is cast to produce an ingot which is 22 inches thick and 65 inches wide. The ingot is scalped on the rolling surfaces to remove 0.5 inches on each side. The ingot is then subjected to a preheat/homogenize treatment wherein it is heated to 1100° F., soaked for 4 hours and cooled to rolling temperature. The ingot is then hot rolled to a 1.5 inch slab in a hot reversing mill, followed by hot rolling to 0.120 inch in a multi-stand hot continuous mill and cold rolled to 0.011 inch. This approach is time-consuming and involves many processing steps.

While it has been suggested to produce aluminum alloy can body sheet by twin roll casting, such approaches have had substantial undesired features. Among the shortcomings are requiting an economically prohibitive number of process steps and unacceptable strength, formability, surface quality and eating properties.

In Effect of Homogenization on the Behavior of Roll Cast 3004 for Can Stock, by D. Teirlinck et al., which appears in Continuous Casting of Non-Ferrous Metals and Alloys, edited by H. D. Merchant et al. (The Minerals, Metals & Materials Society 1989), there is reported extensive testing regarding evaluation of microstructural features of roll cast 3004 as related to mechanical properties, such as earing and galling, it was concluded that homogenization alone did not yield the desired optimal properties for rigid container sheets employed in producing can body stock. A practice of this disclosure involved the use of a 3004 alloy with the addition of 1 to 2 weight percent Si and up to 3.0 weight percent Mg. Comparisons are made between low temperature homogenization and high temperature homogenization. The is also disclosed the use of batch annealing of the roll cast strip followed by cold rolling, further batch annealing and further cold rolling.

U.S. Pat. No. 4,872,921 discloses aluminum alloy sheet for producing can bodies by drawing and ironing and an associated method. Magnesium containing aluminum alloys, such as 3004 and 5182 are disclosed. The patent discloses distributing small particles of amorphous aluminum oxides and crystalline magnesium and aluminum oxides on the sheet surface. The method includes subjecting the cast strip to batch annealing and then cold rolling, followed by batch annealing at a lower temperature and shorter period than the first batch annealing step. The strip is then cold rolled, followed by etching, surface brushing, and batch annealing, followed by cold rolling.

U.S. Pat. No. 4,855,107 discloses the use of a high Si, modified 3XXX alloy in thin aluminum sheet suitable for producing can lids and bodies. It discloses continuously casting a strip to a thickness of 4 to 20 mm and preferably 6 to 12 mm. The strip is then heated to 500° to 620° C. for 2 to 20 hours to homogenize the metal and then cold rolled to an intermediate thickness after which the strip is heated to 500° to 600° C. for 0.5 to 10 minutes, then quenched in air and cold rolled to final thickness.

U.S. Pat. No. 4,111,721 discloses the use of 3003 and 3004 aluminum alloys in sheet for drawn and ironed containers. The sheet is produced by roll casting followed by cold rolling, annealing, further cold rolling, batch annealing, and further cold rolling. The prime objective was to reduce galling during the severe metal working required to produce the drawn and ironed containers. See, also, U.S. Pat. No. 4,238,248 wherein 3004 aluminum alloy strip material was slab cast, hot rolled in a multi-stand operation, cold rolled, continuously annealed, and further cold rolled in order to improve strength and earing properties.

U.S. Pat. No. 4,441,933 discloses the production of aluminum sheets suitable for drawing wherein the roll cast product is subjected to mechanical brushing or subjected to a jet of gas in a cleaning treatment, after which it is subjected to batch annealing or continuous annealing.

U.S. Pat. No. 4,517,034 discloses aluminum sheet of a 3004 alloy with the addition of chromium for use in the can environment. The roll cast material is batch annealed and then cold rolled, followed by two further cycles of batch annealing and cold rolling. See, also, U.S. Pat. No. 4,334,935 wherein an Al—Mn aluminum, alloy is twin roll cast, followed by slab annealing to precipitate most of the Mn in fine intermetallic particles, cold rolling with annealing between cold rolling stages and annealing the final sheet.

U.S. Pat. No. 5,106,429 discloses production of strip stock for use in aluminum cans. It discloses strip casting a 3004 aluminum alloy after which the strip was hot rolled, annealed and cold rolled.

U.S. Pat. No. 4,269,632 discloses a method of converting aluminum scrap into container sheet from which drawn and ironed can bodies and easy-opening can ends may be manufactured. The process employs an alloy consisting essentially of silicon 0.1 to 1.0 percent, iron 0.1 to 0.9 percent, manganese 0.4 to 1.0 percent, magnesium 1.3 to 2.5 percent, copper 0.05 to 0.4 percent, and titanium 0 to 0.2 percent with the balance being essentially aluminum. The disclosure contemplates direct chill casting, followed by scalping, prehearing, hot breakdown rolling, continuous hot rolling, annealing, cold rolling and shearing, followed by either coating and can end manufacture or can body manufacture and coating.

In spite of the foregoing disclosures, there remains a substantial need for an effective process of producing aluminum alloy can sheet in an economical manner while having the desired strength, earing properties and surface characteristics.

SUMMARY OF THE INVENTION

The present invention has met the hereinabove described needs. In a preferred practice of the present invention for making body stock, an aluminum alloy strip is created by roll casting an alloy consisting essentially of 0.8 to 2.0 weight percent Mn, 0.4 to 1.5 weight percent Fe, 0.3 to 1.5 weight percent Mg, 0.1 to 0.4 weight percent Cu, and up to 0.4 weight percent Si, with the balance being essentially aluminum and normal impurities. The strip is then subjected to batch annealing, followed by cold rolling to an intermediate thickness. At intermediate gauge, the strip is continuously annealed and quenched before cold rolling to final gauge. The rapid heat-up rate facilitates desirable recrystallization to a fine grain size which improves formability of the final sheet. An important aspect of the invention is the use of the continuous anneal which traps high levels of solute in the alloy. This, in turn, promotes rapid work hardening during cold rolling. As a result, less cold work is required to generate the desired properties. This gives the product enhanced formability and low earing properties. It will be appreciated that unlike the prior art batch anneal process, the continuous anneal facilitates the production of high strength sheet with much less solute and/or cold work than conventional 5XXX end stock or 3XXX body stock. The resulting strip work hardens at a higher rate making possible the use of lower solute for the can end stock and reduced amounts of cold work for the can body stock to reduce earing.

In another embodiment of the invention wherein can end stock is produced, the alloy employed would consist essentially of 0.2 to 1.0 weight percent Mn, 0.1 to 0.5 weight percent Fe, 1.0 to 3.0 weight percent Mg, 0.2 to 0.5 weight percent Cu, and up to 0.3 weight percent Si, with the balance being essentially aluminum and impurities. The process for making can end stock is preferably that disclosed herein for body stock except that batch annealing may be eliminated and the cast material would be cold rolled to intermediate anneal gauge without a prior heat treatment.

The sheet produced in this manner may be converted to can bodies and can ends by conventional methods as the method involves manufacturing a plurality of aluminum can bodies from said cold rolled aluminum alloy sheet.

It is an object of the present invention to provide a process for producing aluminum alloy sheet to create aluminum alloy can body and can end sheet having improved properties of strength, surface characteristics and earing properties.

It is another object of the present invention to produce such sheet which has desired surface quality which in order to enhance efficiency of manufacture and maintain the cost of the same within reasonable ranges is achieved without requiring surface cleaning or treatment prior to final cold rolling.

It is another object of the present invention to provide a method of producing aluminum can bodies and can ends from thin roll cast strips while eliminating the need to employ ingot or slab casting, scalping and hot rolling processes.

It is another object of the present invention to provide a method of making such sheet employing unique alloys.

It is a further object of the present invention to produce aluminum alloy sheet which is suited in respect of strength, earing and surface qualities to be employed in manufacturing can bodies and ends.

It is a further object of the present invention to provide a unique casting alloys for use in producing aluminum alloy can body sheet and can end sheet.

These and other objects of the invention will be more fully understood from the following detailed description of the invention.

DESCRIPTION OF THE PREFERRED EMBODIMENTS

The present invention has met the hereinabove described needs. In a preferred practice of the present invention in making can body stock, an aluminum alloy strip is created by roll casting an alloy to a thickness of about 1 to 5 mm. The alloy 90 consists essentially of 0.8 to 2.0 weight percent Mn, 0.4 to 1.5 weight percent Fe, 0.3 to 1.5 weight percent Mg, 0.1 to 0.4 weight percent Cu, and up to 0.4 weight percent Si, with the balance being essentially aluminum and normal impurities. In a preferred embodiment of the invention, the can body stock will be made from a castable aluminum alloy consisting essentially of 1.2 to 1.6 weight percent Mn, 0.6 to 0.9 weight percent Fe, 0.3 to 0.7 weight percent Mg, 0.25 to 0.35 weight percent Cu, and up to 0.4 weight percent Si, with the balance being essentially aluminum and normal impurities. The roll cast strip preferably has a thickness of about 1 to 5 mm. The strip is then subjected to batch annealing at about 580° to 610° C. for about 2 to 16 hours, followed by cold rolling to an intermediate thickness which may be about 0.35 to 0.7 mm and continuous annealing of the intermediate gauge strip at about 450° to 560° C. for less than 1 minute. The strip is then subjected to quenching in air or water and cold rolled to the desired gauge which is about 0.2 to 0.4 mm and, preferably, about 0.2 to 0.3mm.

In another embodiment of the invention wherein can end stock is to be produced, the alloy employed would consist essentially of 0.2 to 1.0 weight percent Mn, 0.1 to 0.5 weight percent Fe, 1.0 to 3.0 weight percent Mg, 0.2 to 0.5 weight percent Cu, and up to 0.3 weight percent Si, with the balance being essentially aluminum and normal impurities. The preferred aluminum alloy for can end stock would be an alloy consisting essentially of 0.5 to 0.8 weight percent Mn, 0.1 to 0.3 weight percent Fe, 1.5 to 2.5 weight percent Mg, 0.3 to 0.5 weight percent Cu, and up to 0.2 weight percent Si, with the balance being essentially aluminum and normal impurities.

In producing can end stock, the process hereinbefore described for the production of body stock may be employed except that the batch annealing may be eliminated and the east material would be cold rolled to intermediate anneal gauge without a prior heat treatment. The intermediate anneal gauge will preferably be about 0.5 to 1.0 mm. The subsequent continuous anneal is preferably preformed at 450° to 520° C. for less than 1 minute, after which the strip is cold rolled to final gauge of 0.15 to 0.4 mm and, preferably, about 0.2 to 0.3 mm.

The sheet produced in accordance with the foregoing methods may be convened, respectively, to can bodies by conventional drawing and ironing methods or can ends by conventional means.

The sheet produced by these methods produces aluminum alloy can body sheet and can end sheet having better combinations of strength and earing properties with acceptable surface characteristics, respectively, than 3004 can body sheet or 5182 can end sheet made from a conventional 12 to 24 inch thick ingot slab. All of this is accomplished without requiting surface cleaning or other surface treatment or hot rolling prior to final cold rolling, except for the effective hot rolling experienced during the roll casting operation.

In another embodiment of the invention, an aluminum alloy falling within either of the two ranges disclosed herein for the method of making can body stock may be processed by a method of making can end stock disclosed herein. This embodiment will produce can sheet which may be employed to manufacture either can bodies or can ends. In this manner, the same sheet material will serve a dual purpose.

It will be appreciated, therefore, that the present invention has provided an economical and effective means of producing aluminum alloy sheet having high strength and desired surface and earing characteristics. All of this is accomplished in a manner which enhances speed of production by eliminating a number of prior art thermal and cleaning processes between the as-cast product and the cold rolling stage. This is in part facilitated by the casting of a relatively thin slab, the thermal treatments employed and the selection and use of certain preferred alloys. The invention is particularly useful in crearing sheet usable in aluminum alloy can bodies and can ends.

Whereas particular embodiments of the invention have been described herein for purposes of illustration, it will be evident to those skilled in the art that numerous variations of the details may be made without departing from the invention as set forth in the appended claims.

We claim:

1. A method of producing aluminum alloy can body stock comprising employing as said aluminum alloy an alloy consisting essentially of 0.8 to 2.0 weight percent Mn, 0.4 to 1.5 weight percent Fe, 0.3 to 1.5 weight percent Mg, 0.1 to 0.4 weight percent Cu, and up to 0.4 weight percent Si with the balance being essentially aluminum and normal impurities, roll casting an aluminum alloy strip having a thickness of about 1 to 5 mm, batch annealing said strip at about 580° to 610° C. for about 2 to 16 hours, cold rolling said strip without prior hot rolling of said strip, continuous annealing said cold rolled strip at about 450° to 560° C. for less than 1 minute, quenching said strip, and cold rolling said strip to aluminum alloy sheet of the desired gauge.

2. The method of claim 1 including effecting by the first cold rolling step a strip thickness of 0.35 to 0.7 mm.

3. The method of claim 2 including effecting by the second cold rolling step a strip thickness of about 0.2 to 0.3 mm.

4. The method of claim 3 including effecting said second cold rolling without prior hot rolling of said strip.

5. The method of claim 2 including employing an air quench as said quench.

6. The method of claim 2 including employing a water quench as said quench.

7. The method of claim 1 including effecting said second cold rolling without any prior surface treatment of said strip.

8. The method of claim 1 including said alloy consisting essentially of 1.2 to 1.6 weight percent Mn, 0.6 to 0.9 weight percent Fe, 0.3 to 0.7 weight percent Mg, 0.25 to 0.35 weight percent Cu, and up to 0.4 weight percent Si, with the balance being essentially aluminum and normal impurities.

9. A method of making aluminum alloy can bodies comprising employing as said aluminum alloy an alloy consisting essentially of 0.8 to 2.0 weight percent Mn, 0.4 to 1.5 weight percent Fe, 0.3 to 1.5 weight percent Mg, 0.1 to 0.4 weight percent Cu, and up to 0.4 weight percent Si with the balance being essentially aluminum and normal impurities, roll casting an aluminum alloy strip having a thickness of about 1 to 5 mm, batch annealing said strip at about 580° to 610° C. for about 2 to 16 hours, cold rolling said strip without prior hot rolling of said strip, continuous annealing said cold rolled strip at about 450° to 560° C. for less than 1 minute, quenching said strip, cold rolling said strip to aluminum alloy sheet of the desired gauge, and manufacturing a plurality of aluminum can bodies from said cold rolled aluminum alloy sheet.

10. The method of claim 9 including effecting by first said cold rolling a strip thickness of 0.35 to 0.7 mm.

11. The method of claim 10 including effecting by second said cold rolling a strip thickness of about 0.2 to 0.3 mm.

12. The method of claim 11 including employing an air quench as said quench.

13. The method of claim 11 including employing a water quench as said quench.

14. The method of claim 11 including effecting said second cold rolling without prior hot rolling of said strip.

15. The method of claim 9 including effecting said second cold rolling without any prior surface treatment of said strip.

16. A method of producing aluminum alloy can end stock comprising employing as said aluminum alloy an alloy consisting essentially of 0.2 to 1.0 weight percent Mn, 0.1 to 0.5 weight percent Fe, 1.0 to 3.0 weight percent Mg, 0.2 to 0.5 weight percent Cu, and up to 0.3 weight percent Si, with the balance being essentially aluminum and normal impurities, roll casting an aluminum alloy strip having a thickness of about 1 to 5 mm, cold rolling said strip without prior hot rolling of said strip, continuous annealing said cold rolled strip at about 450° to 560° C. for less than 1 minute, quenching said strip, and cold rolling said strip to aluminum alloy sheet of the desired gauge.

17. The method of claim 16 including effecting by the first cold rolling step a strip thickness of about 0.5 to 1.0 mm.

18. The method of claim 17 including effecting by the second cold rolling step a strip thickness of about 0.15 to 0.4 min.

19. The method of claim 17 including employing an air quench as said quench.

20. The method of claim 17 including employing a water quench as said quench.

21. The method of claim 17 including effecting said first cold rolling without prior thermal treatment of said strip.

22. The method of claim 17 including effecting the second cold rolling step without prior hot rolling of said strip.

23. The method of claim 22 including effecting said second cold rolling without any prior surface treatment of said strip.

24. The method of claim 17 including said alloy consisting essentially of 0.5 to 0.8 weight percent Mn, 0.1 to 0.3 weight percent Fe, 1.5 to 2.5 weight percent Mg, 0.3 to 0.5 weight percent Cu, and up to 0.2 weight percent Si with the balance being essentially aluminum and normal impurities.

25. A method of making aluminum alloy can ends comprising employing as said aluminum alloy an alloy consisting essentially of 0.2 to 1.0 weight percent Mn, 0.1 to 0.5 weight percent Fe, 1.0 to 3.0 weight percent Mg, 0.2 to 0.5 weight percent Cu, and up to 0.3 weight percent Si, with the balance being essentially aluminum and normal impurities, roll casting an aluminum alloy strip having a thickness of about 1 to 5 mm, cold rolling said strip without prior hot rolling of said strip, continuous annealing said cold rolled strip at about 450° to 560° C. for less than 1 minute, quenching said strip, cold rolling said strip to aluminum alloy sheet of the desired gauge, and manufacturing a plurality of aluminum can ends from said cold rolled aluminum sheet alloy.

26. The method of claim 25 including effecting by the first cold rolling step a strip thickness of about 0.5 to 1.0 mm.

27. The method of claim 26 including effecting by the second cold rolling step a strip thickness of about 0.15 to 0.4 mm.

28. The method of claim 25 including employing an air quench as said quench.

29. The method of claim 25 including employing a water quench as said quench.

30. The method of claim 25 including effecting said first cold rolling without prior thermal treatment of said strip.

31. The method of claim 26 including effecting the second cold rolling step without prior hot rolling of said strip.

32. The method of claim 31 including effecting said second cold rolling without any prior surface treatment of said strip.

33. The method of claim 26 including said alloy consisting essentially of 0.5 to 0.8 weight percent Mn, 0.1 to 0.3 weight percent Fe, 1.5 to 2.5 weight percent Mg, 0.3 to 0.5 weight percent Cu, and up to 0.2 weight percent Si with the balance being essentially aluminum and normal impurities.

34. A method of producing aluminum alloy can stock comprising employing as said aluminum alloy an alloy consisting essentially of 0.8 to 2.0 weight percent Mn, 0.4 to 1.5 weight percent Fe, 0.3 to 1.5 weight percent Mg, 0.1 to 0.4 weight percent Cu, and up to 0.4 weight percent Si with the balance being essentially aluminum and normal impurities, roll casting an aluminum alloy strip having a thickness of about 1 to 5 mm, cold rolling said strip without, prior hot rolling of said strip, continuous annealing said cold rolled strip at about 450° to 560° C. for less than 1 minute, quenching said strip, and cold rolling said strip to aluminum alloy sheet of the desired gauge.

35. The method of claim 34 including said alloy consisting essentially of 1.2 to 1.6 weight percent Mn, 0.6 to 0.9 weight percent Fe, 0.3 to 0.7 weight percent Mg, 0.25 to 0.35 weight percent Cu, and up to 0.4 weight percent Si, with the balance being essentially aluminum and normal impurities.

36. The method of claim 35 including employing said method to produce can body stock.

37. The method of claim 35 including employing said method to produce can end stock.

* * * * *